US006343752B1

(12) United States Patent
Sleasman et al.

(10) Patent No.: US 6,343,752 B1
(45) Date of Patent: Feb. 5, 2002

(54) INDOOR WASTEWATER DISPOSAL SYSTEM AND TANK THEREFOR

(75) Inventors: Andrew P. Sleasman, Gansvoort; Paul Zalewski, Schenectady; Eric R. Hess, Scotia, all of NY (US)

(73) Assignee: Environment One Corporation, Niskayuna, NY (US)

( * ) Notice: Subject to any disclaimer, the term of this patent is extended or adjusted under 35 U.S.C. 154(b) by 0 days.

(21) Appl. No.: 09/454,543

(22) Filed: Dec. 7, 1999

(51) Int. Cl.[7] ..... B02C 23/36

(52) U.S. Cl. ..... 241/21; 241/46.017; 241/101.3

(58) Field of Search ..... 241/46.017, 46.02, 241/46.04, 46.06, 46.08, 46.11, 285.1, 285.3, 101.3, 21

(56) References Cited

U.S. PATENT DOCUMENTS

| | | | | |
|---|---|---|---|---|
| 1,204,534 A | | 11/1916 | Andrews | |
| 1,303,358 A | | 5/1919 | Montgomery | |
| 2,676,666 A | | 4/1954 | Howe | |
| 3,318,248 A | | 5/1967 | Rembold | |
| 3,695,520 A | * | 10/1972 | Mauro | 241/46.11 |
| 3,897,600 A | * | 8/1975 | Burkholder | 241/46.017 |
| 3,904,131 A | | 9/1975 | Farrell, Jr. et al. | |
| 4,029,262 A | * | 6/1977 | Lazich et al. | 241/46.017 |
| 4,324,007 A | | 4/1982 | Morris | |
| 4,350,587 A | | 9/1982 | Jarrell | |
| 4,919,343 A | | 4/1990 | Van Luik, Jr. et al. | |
| 5,439,180 A | | 8/1995 | Baughman et al. | |
| 5,441,632 A | | 8/1995 | Charon | |
| 5,553,794 A | | 9/1996 | Oliver et al. | |
| 5,672,050 A | | 9/1997 | Webber et al. | |
| 5,816,510 A | | 10/1998 | Earle, III et al. | |

OTHER PUBLICATIONS

Grainger Catalog, "Submersible Grinder Pumps and Pump Systems," pp. 3151, 3219, and 3221 (1998–1999).
Barns Pumps, Inc. Brochure, "Barnes Submersible Pump Basin," Double Pump Version, 1–page (1995).
Barnes Pumps, Inc. Brochure, "Barnes Submersible Pump Basin," Single–Pump Version, 1–page, (1995).
Interon Corporation, Power Sewer Brochure, 8–pages, Sep. 1998.
Hydromatic Pumps, Inc. Brochure, 20–pages, May 1995.
Zoeller Pump Co. Brochure, "Simplex System/Duplex System," 1–page, date unknown.

* cited by examiner

*Primary Examiner*—Mark Rosenbaum
(74) *Attorney, Agent, or Firm*—Heslin Rothenberg Farley & Mesiti P.C.

(57) ABSTRACT

A self-contained, indoor wastewater disposal system for collecting, grinding, and pumping wastewater is readily installed within a building such as in the basement thereof by connecting to a wastewater feed pipe, to a wastewater discharge pipe, and to an electrical power supply such as a standard 120 volt or 220 volt electrical outlet. The system generally includes a tank, a grinder pump, and an alarm unit for indicating a problem with the operation of the system. The alarm unit is desirably operable to indicate loss of electrical power to the grinder pump, indicate an overflow water level in the tank, and/or indicate adegradation of performance of the grinder pump. The tank may be configured for receiving the wastewater feed pipe from the building at either of two orientations which are disposed ninety-degrees from each other so that the system may be easily and closely positioned adjacent to a wall of the building and so that the connection of the wastewater feed pipe to the tank is obscured from view.

16 Claims, 4 Drawing Sheets

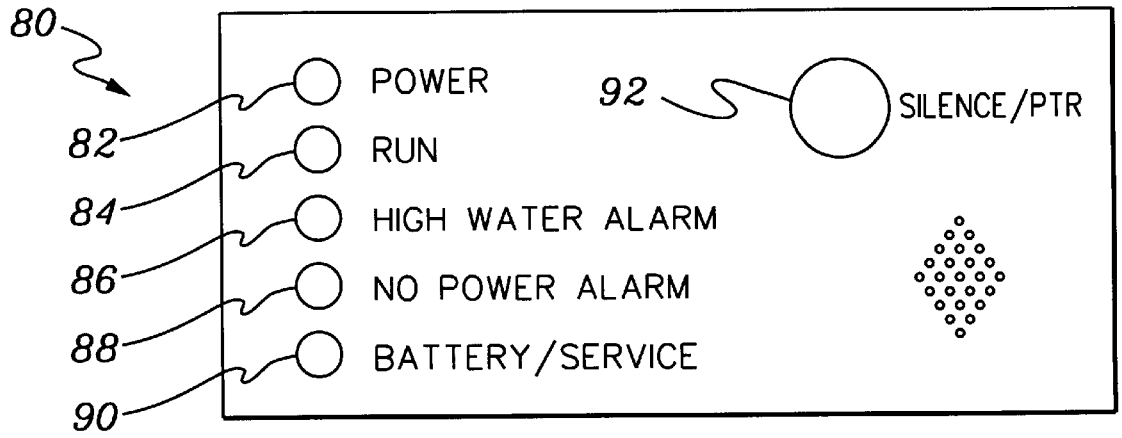
fig. 5
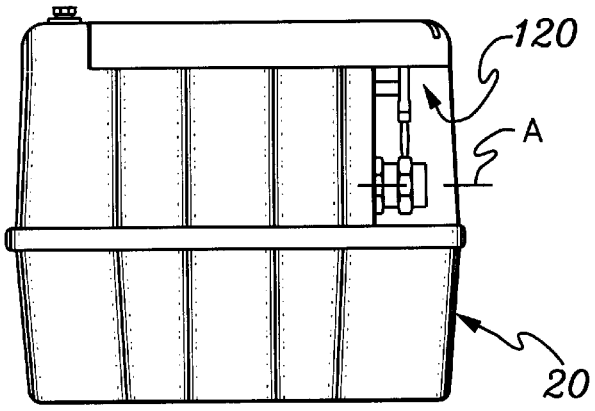
fig. 6
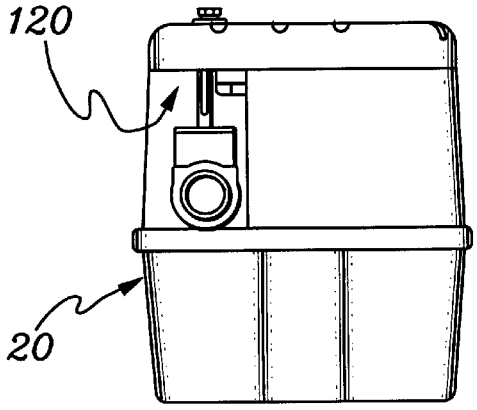
fig. 7
fig. 8
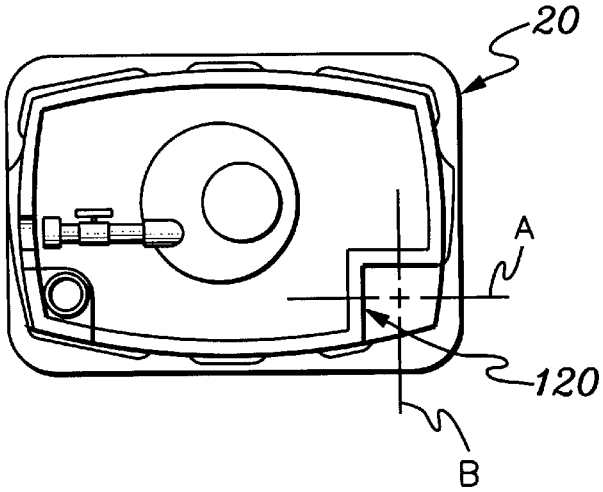

INDOOR WASTEWATER DISPOSAL SYSTEM AND TANK THEREFOR

FIELD OF THE INVENTION

The present invention relates generally to wastewater disposal, and more particularly, to wastewater disposal systems and tanks therefor which are readily installed within a building.

BACKGROUND INFORMATION

Wastewater disposal systems are often used in low-pressure sewage systems for grinding and pumping wastewater. Such systems include a grinder pump having a grinder mechanism for cutting or grinding solids or semisolid matter in the wastewater being pumped.

Wastewater disposal systems are typically installed outdoor underground. Drawbacks with installing a wastewater disposal system outdoor include excavating the site, leveling and connecting the system to a wastewater pipe, running electrical wires from a circuit breaker box to the system, connecting a control unit for control of the operation of the system, and repairing the site after installing the system.

Therefore, there is a need for a convenient, self-contained, indoor wastewater disposal system which is readily installed in a building such as in the basement of a home.

SUMMARY OF THE INVENTION

Pursuant to the present invention, the shortcomings of the prior art are overcome and additional advantages provided by a wastewater disposal system which is installable within a building to collect, grind, and pump wastewater and which includes a tank having a generally sealable chamber for receiving wastewater from a wastewater feed pipe in the building, a grinder pump disposed in the tank and having a discharge pipe attachable to a wastewater discharge pipe in the building, and an alarm unit for indicating loss of electrical power to the grinder pump, indicating an overflow water level in the tank, and/or indicating degradation of performance of the grinder pump.

In another aspect, a wastewater disposal system is provided which is installable within a building to collect, grind, and pump wastewater, and which includes a tank having a generally sealable chamber for receiving wastewater from a wastewater feed pipe in the building, a grinder pump disposed in the tank and having a pipe attachable to a wastewater discharge pipe in the building, an alarm unit for indicating a problem with the operation of the wastewater disposal system, and an electrical cord for providing electrical power to the grinder pump and the alarm unit. The electrical cord includes a standard electrical plug attachable to a standard electrical outlet in the building.

Desirably, the tank may include a bottom wall, a top wall, and a sidewall attached to the bottom wall and to the top wall to define a chamber therein. The top wall includes an opening for receiving the grinder pump in a sealably attachable arrangement and the sidewall includes an inwardly extending portion through which a wastewater feed pipe is passable at either a first orientation or a second orientation ninety degrees from the first orientation. Advantageously, the bottom wall, the top wall, and the sidewall define a generally box-shaped configuration having a height, a width, and a depth, and in which the height is less than the width and the depth.

BRIEF DESCRIPTION OF THE DRAWINGS

These and other objects, advantages and features of the present invention will be more readily understood from the following detailed description of a preferred embodiment of the present invention, when considered in conjunction with the accompanying drawings in which:

FIG. 5 is a top view of the display panel of the alarm unit shown in FIGS. 2 and 3;

FIGS. 6 and 7 are elevational side views of the indoor wastewater disposal system shown in FIG. 1; and FIG. 8 is a top view of the indoor wastewater disposal system shown in FIG. 1 with the cover removed.

DETAILED DESCRIPTION OF THE INVENTION

Figure 1:
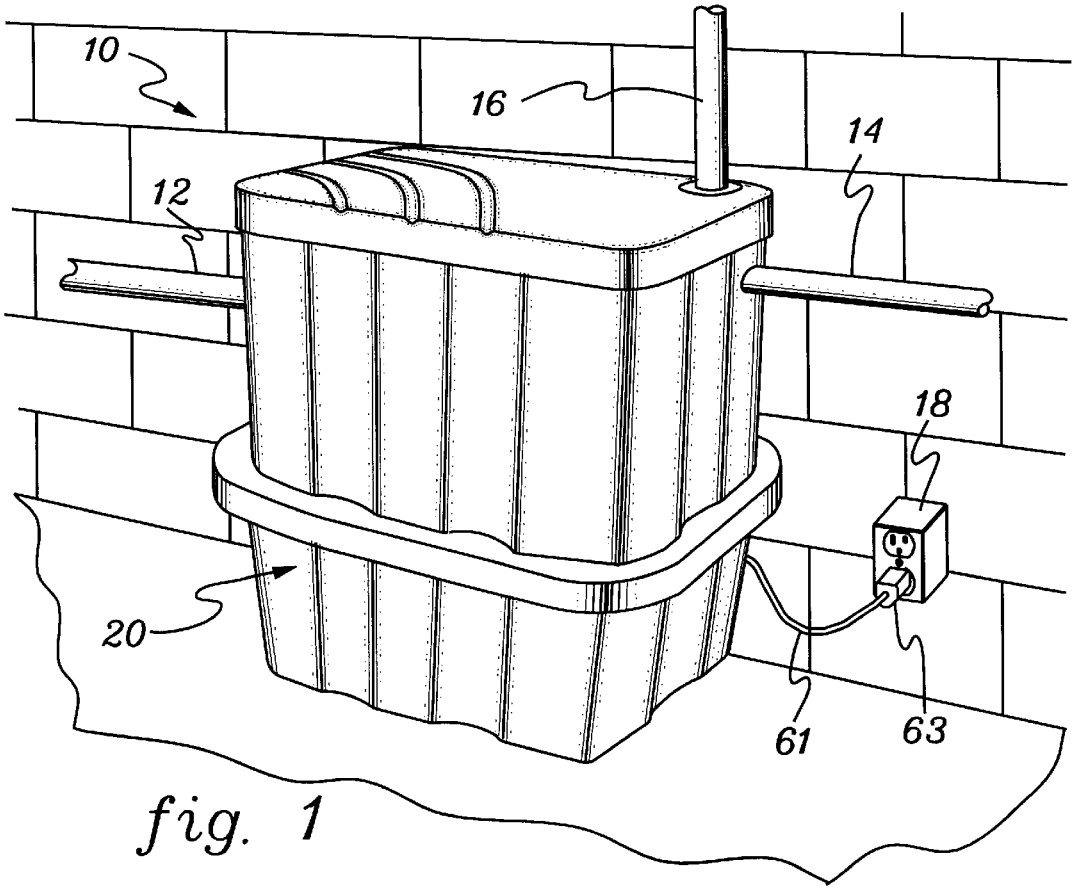
FIG. 1 is a perspective view of an indoor wastewater disposal system according to the present invention.

FIG. 1 illustrates an exemplary indoor wastewater disposal system 10 according to the present invention for collecting, grinding, and pumping wastewater. Indoor wastewater disposal system 10 is readily installable within a building such as in the basement of a home by connecting the system to a wastewater feed pipe 12, to a wastewater discharge pipe 14, and to an electrical power supply such as a standard 120 volt or 220 volt electrical outlet 18 via an electrical cord 61 having a standard electrical plug 63. The system may also be connected to a vent 16. The exemplary indoor wastewater disposal system provides an convenient, self-contained unit having alarm features for notifying a building supervisor or a homeowner of a problem with the system. In addition, the exemplary system is readily accessible and serviceable by a technician or repair person.

Figure 2:
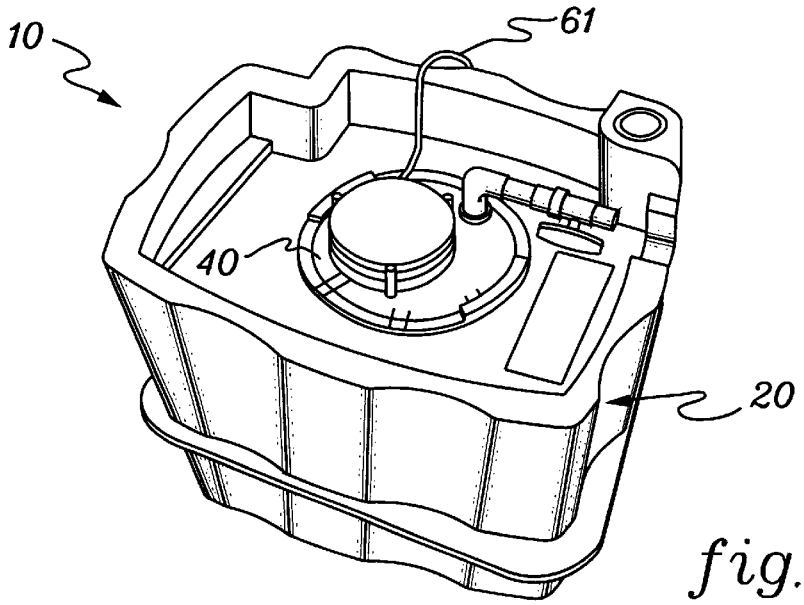
FIG. 2 is a perspective view of the indoor wastewater disposal system shown in FIG. 1 with the cover removed.
Figure 3:
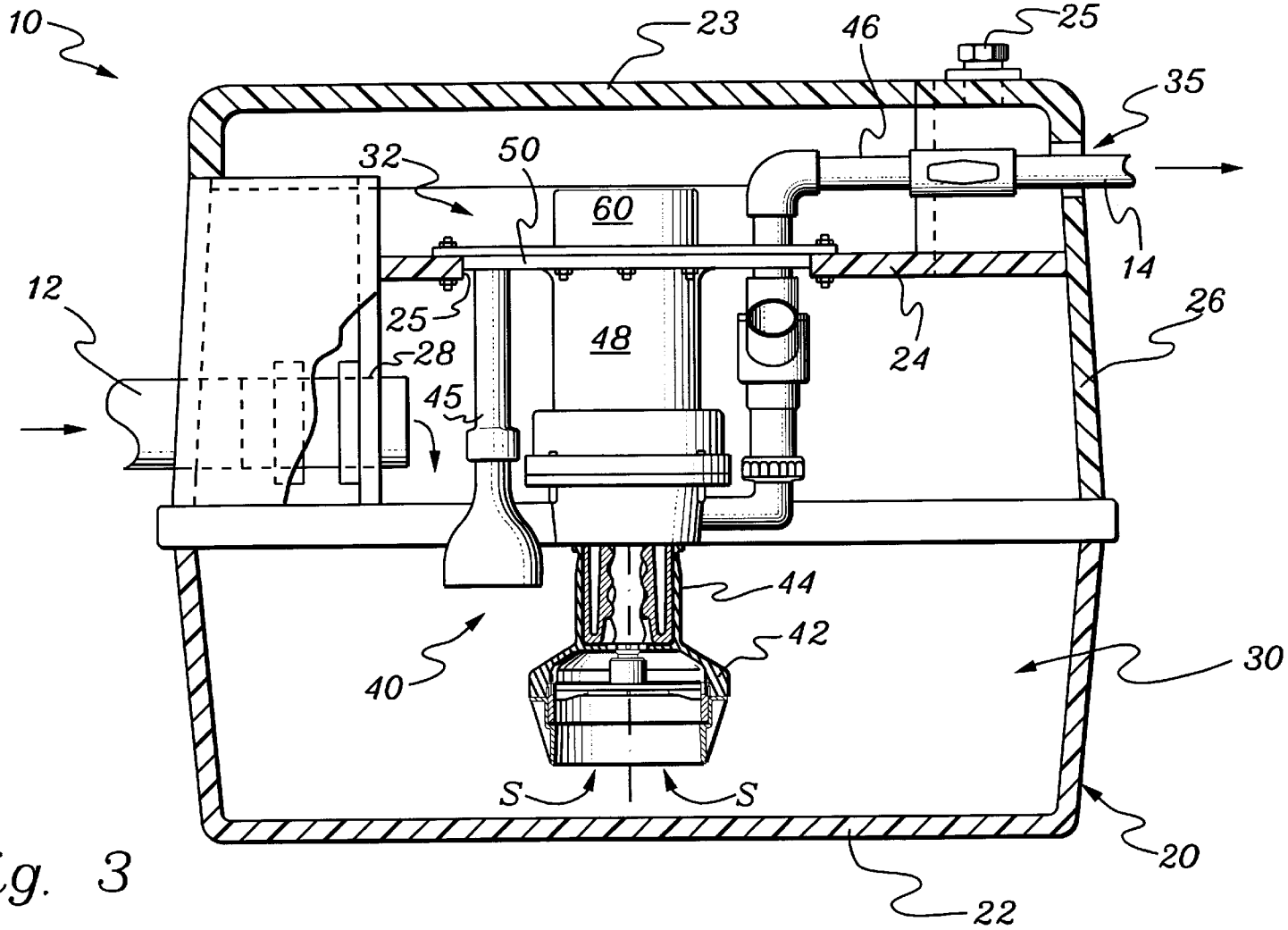
FIG. 3 is a cross-sectional view of the indoor wastewater disposal system shown in FIG. 1.

With reference to FIGS. 2 and 3, system 10 generally includes a tank 20, a grinder pump 40 (FIG. 3), and an alarm unit 60 for monitoring the operation of system 10.

As best shown in FIG. 3, tank 20 includes a bottom wall 22, a top wall 24, and a surrounding sidewall 26 attached to bottom wall 22 and to top wall 24 to define a sealable chamber 30 therein for receiving wastewater from the building. Sidewall 26 includes an inlet 28 sealably attachable to a feed wastewater pipe 12 in the building. Top wall 24 includes an opening 25 for receiving grinder pump 40. Desirably, grinder pump 40 is sealably attachable to top wall 24. In addition, tank 20 may include a releasably sealable cap 25 for sealing vent opening 27 so that chamber 30 may be sealed from the atmosphere where a vent is not provided.

Desirably, an upper portion 27 of sidewall 26 extends above top wall 24 to define second chamber 32 for alarm unit 60. A cover 23 is releasably attachable to upper portion 27 of surrounding sidewall 26 to provide a compact, self-contained, wastewater disposal system.

Advantageously, cover 23 and upper portion 27 of surrounding sidewall 26 define an opening 35 through which discharge pipe 14 is passable. Desirably, tank 20 has a box-shaped configuration having a height, a width, and a depth, and in which the height is less than the width and/or the depth to provide a stable configuration which is inhibited from moving during operation.

Grinder pump 40 includes a grinder mechanism 42 for pulverizing solids or semisolid matter in the wastewater, a pump assembly 44 attached to grinder mechanism 42 for pumping ground wastewater through grinder pump 40, and a motor (not shown). For example, a grinder mechanism may include a stationary outer ring and a rotating cutting blade, and a pump assembly may include a progressing cavity pump having a pump housing, a pump stator, and a pump rotor. It will be appreciated by those skill in the art that other suitable grinder pumps, grinding mechanisms and pump assemblies may be employed.

A motor housing casting 48 houses the electric motor (not shown) for powering both grinder mechanism 42 and pump assembly 44. Housing 48 is preferably attached to a support 50 which is sealably and releasably attachable to top wall 24 of tank 20 for supporting grinder pump 40 within chamber 30. A suitable motor is an electrical motor desirably rated at about one horsepower, 1,725 rpm, and having high torque and a capacitor starting mechanism.

Grinder pump 40 includes a pipe 46, which is connected to wastewater discharge pipe 14. In operation, wastewater is drawn into grinder mechanism 42, as illustrated by the curved arrows S in FIG. 3, for cutting or grinding of the solids or semisolid matter in the wastewater. The resulting processed particulate effluent passes through pump assembly 44, pipe 46, and then wastewater discharge pipe 14.

Figure 4:
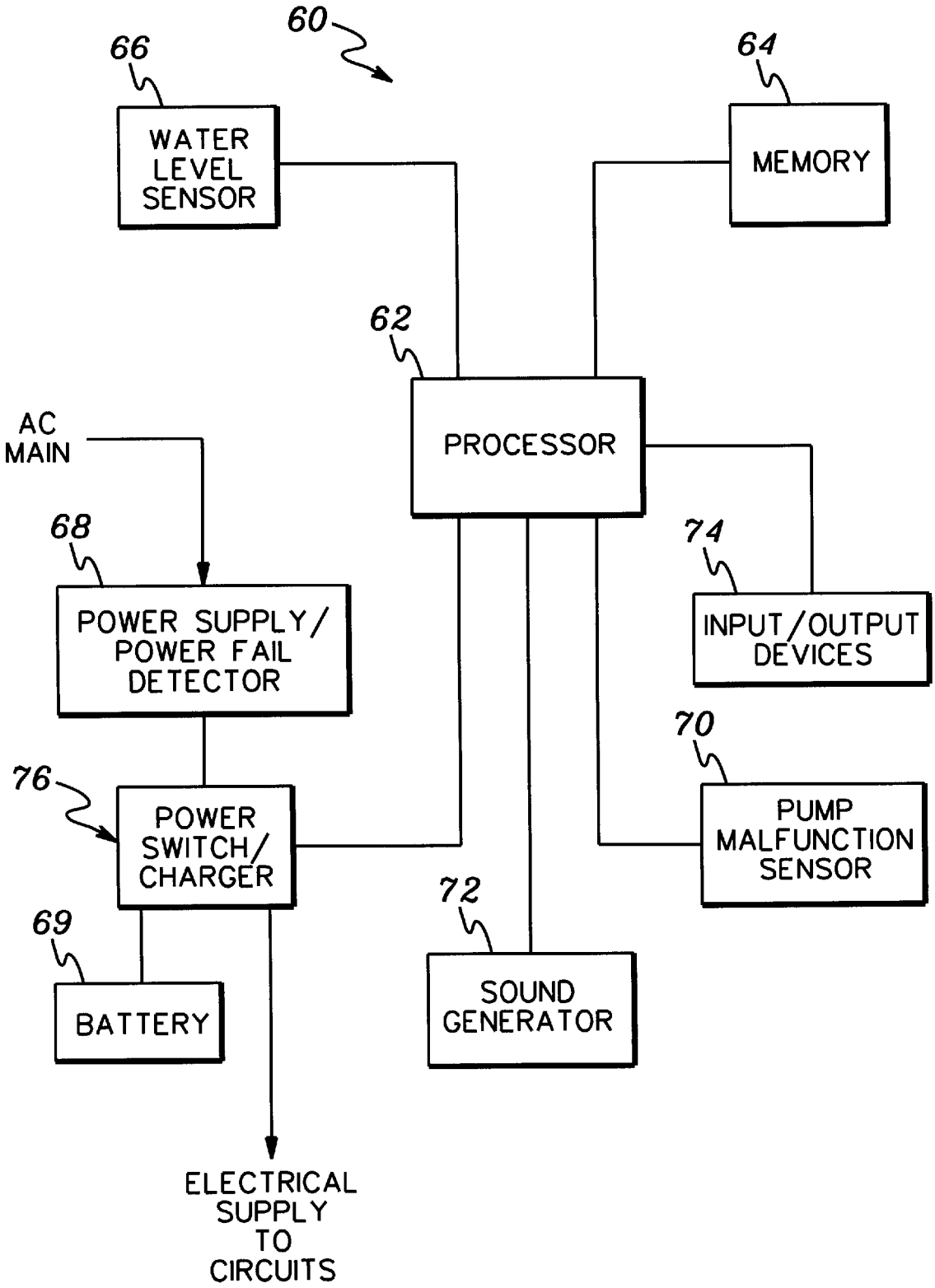
FIG. 4 is a block diagram of the alarm unit shown in FIGS. 2 and 3.

FIG. 4 is a block diagram of alarm unit 60 of the present invention for monitoring and indicating one or more problems with the operation of system 10. Alarm unit 60 includes a processor 62, memory 64, a water level sensor 66 such as a sensing tube 45 (FIG. 3), a power supply/power fail detector 68, a power switch/charger 76 connectable to a battery 69, a sound generator 72 such as a speaker or a buzzer for producing an audible sound, and input/output devices 74 such as LEDs 82–90 (FIG. 5) and an override button 92 (FIG. 5). It will be appreciated that other sensors for detecting problematic conditions with system 10 can also be incorporated into alarm unit 60.

Processor 62 may include a microprocessor controller unit having a MC68HC705PA processor manufactured by Motorola, Inc. The processor is run by application software or programming, e.g., assembly language, and is typically governed by the manufacturer's protocol.

The invention is not limited to such a processing environment. In addition, the present invention can be incorporated and used within many types of processing environments. From the following description, computer readable program code means for use in processor 62 and for implementing the diagnostic and alarm monitoring and indicating capabilities of the present invention may be readily programmed by those skilled in the art and stored in memory 64 such as in one or more memory chips.

With reference again to FIG. 3, grinder pump 40 may include one or more sensing tubes 45 to sense pressure variations for measuring the level of wastewater collected in tank 20. Processor 62 (FIG. 4) and/or a mechanical-electrical relay are desirably operable, upon the wastewater reaching a predetermined wastewater level, to energize the motor within motor housing casting 48. The wastewater collected in grinder pump 10 will then be ground by grinder mechanism 42 and thereafter pumped by pump assembly 44 via pipe 46 to wastewater discharge pipe 14. From wastewater discharge pipe 14, the processed wastewater may travel to a remote location, e.g., to a pressure sewage main and ultimately to a sewage treatment plant.

Suitable high water triggering mechanisms and their operation are disclosed in U.S. Pat. Nos. 4,919,343 and 5,439,180, the subject matter of these references are incorporated herein by reference.

FIG. 5 illustrates a diagnostics display 80 of alarm unit 60. Exemplary display 80 includes a plurality of light-emitting diodes (LEDs) 82, 84, 86, 88, and 90, for indicating power, run, high water alarm, no power alarm, and battery/service, respectively. Advantageously, the plurality of light-emitting diodes are viewable when the cover 23 is removed. Display 80 may also include a push button 92 for silencing alarm unit 60 (FIG. 4) and for manually causing grinder pump 40 (FIG. 3) to operate in an override mode. Desirably, alarm unit 60 provides an audible alarm which calls attention to the system in the event of a problem, in addition to the light emitting diodes identifying the specific type of problem.

For example, LED 82 is desirably a green light which when illuminated, indicates that the grinder pump is being supplied proper power. LED 84 is also desirably a green light which when illuminated, indicates the grinder pump is operating.

LEDs 86, 88, 90 are desirably red lights. For example, detection of a high water condition may be indicated by illumination of LED 86 and a continuous two tone ring emitted from sound generator 72. Alarm unit 60 desirably includes a two-minute delay before an alarm is sounded to avoid false alarms where the wastewater level quickly returns to a normal level. The sound generator may be powered by battery 69 when the AC electrical power to the building is out.

If no electrical power from the building is supplied to the system assessed by power supply/power fail detector 68, LED 88 desirably blinks and is accompanied by the cycling, e.g., occasional ringing or pulsing of sound generator 72.

LED 90 is desirably a yellow LED which when continuously illuminated indicates service is required (for example, as triggered by pump malfunction sensor 70), and when blinking indicates that battery 69 needs to be replaced or installed. A ringing tone from the sound generator desirably accompanies the illumination of LED 90.

The ringing of sound generator 72 is silenced by pressing the push button 92. In addition, desirably continuously pressing push button 92 for about five seconds manually starts and runs grinder pump 40 until push button 92 is released.

A backup battery connected to alarm unit 60 is desirably replaceable and/or rechargeable. Preferably, the backup battery is operable to sound the alarms and illuminate the LEDs for a minimum of twenty-four hours. Desirably, cycling or pulsing illumination of the LEDs and generation of sound energy conserves energy, particularly when alarm unit 60 is powered by a backup battery. For example, several second/minutes or more may pass between pulses of light or sound which may be on the order of only a fraction of a second.

Another aspect of the present invention includes connecting tank 20 to wastewater feed pipe at various orientations so that wastewater disposal system 10 may be easily and closely positioned adjacent a wall of the building, and advantageously so that the connection of the wastewater feed pipe to tank 20 is obscured from view.

For example, with reference to FIGS. 6–8, tank 20 may include sidewall 26 having an inwardly extending side portion 120 through which wastewater feed pipe 12 (FIG. 3) is passable at least a first orientation A (FIGS. 6 and 8) and a second orientation B (FIG. 8). Desirably, orientation A is about ninety degrees from orientation B.

From the present description, it will be appreciated by those skilled in the art that an additional remote alarm and/or indicator light may be connected to the alarm unit of the wastewater disposal system. For example, a remote alarm and/or indicator light may be disposed in a building supervisor's office or in a room upstairs in a home.

Thus, while one embodiment of the present invention has been illustrated and described, it will be appreciated to those skilled in the art that many changes and modifications may be made thereunto without departing from the spirit and scope of the invention.

What is claimed is:

1. A wastewater disposal system installable within a building to collect, grind, and pump wastewater, the wastewater disposal system comprising:

a tank having a generally sealable chamber having an inlet port attachable to a wastewater feed pipe in the building;

a grinder pump disposed in said tank and having a grinder and a pump, said grinder pump having a discharge pipe attachable to a wastewater discharge pipe in the building; and an alarm unit for at least one of indicating loss of electrical power to said grinder pump, indicating an overflow water level in said tank, and indicating service required for degradation of performance of said grinder pump prior to failure of said grinder pump.

2. The wastewater disposal system of claim 1 wherein said alarm unit is operable for indicating loss of electrical power to said grinder pump and for indicating an overflow water level in said tank.

3. The wastewater disposal system of claim 1 wherein said alarm unit is operable to indicate service required for degradation of performance of said grinder pump prior to failure of the grinder pump.

4. The wastewater disposal system of claim 1 wherein said alarm unit comprises a sound generator for producing an audible sound.

5. The wastewater disposal system of claim 4 wherein said sound generator is operable to produce a pulsating audible sound.

6. The wastewater disposal system of claim 1 wherein said alarm unit comprises a power switch/charger connectable to a battery for providing backup power to said alarm unit.

7. The wastewater disposal system of claim 1 wherein said tank surrounds said grinder pump and said alarm unit.

8. The wastewater disposal system of claim 1 further comprising an electrical cord for providing electrical power to said grinder pump and to said alarm unit, said electrical cord having a standard electrical plug attachable to a standard electrical outlet in the building.

9. The wastewater disposal system of claim 1 wherein the tank comprises:

a bottom wall;

a top wall;

a sidewall attached to said bottom wall and to said top wall to define a sealable chamber therein;

said top wall having an opening for receiving a grinder pump in a sealably attachable arrangement; and said sidewall comprising an inwardly extending portion through which a wastewater feed pipe is passable at at least a first orientation and a second orientation.

10. The wastewater disposal system of claim 1 wherein the tank comprises:

a bottom wall;

a top wall having an opening for receiving a grinder pump in a sealably attachable arrangement;

a sidewall attached to said bottom wall and to said top wall to define a sealable chamber therein, said sidewall comprising an upper sidewall portion extending above said top wall; and a cover releasably attachable to said upper portion of said sidewall.

11. A wastewater disposal system installable within a building to collect, grind, and pump wastewater, the wastewater disposal system comprising:

a tank having a generally sealable chamber having an inlet port attachable to a wastewater feed pipe in the building;

a grinder pump disposed in said tank and having a grinder and a pump, said grinder pump having a pipe attachable to a wastewater discharge pipe in the building;

an alarm unit for indicating a problem with the operation of said wastewater disposal system; and an electrical cord for providing electrical power to said grinder pump and said alarm unit, said electrical cord having a standard electrical plug attachable to a standard electrical outlet in the building.

12. The wastewater disposal system of claim 11 wherein said tank surrounds said grinder pump and said alarm unit.

13. The wastewater disposal system of claim 11 wherein said alarm unit is operable for at least one of indicating loss of electrical power to said grinder pump, indicating an overflow water level in said tank, and indicating degradation of performance of said grinder pump.

14. The wastewater disposal system of claim 11 wherein said alarm unit comprises a power switch/charger connectable to a battery for providing backup power to said alarm unit.

15. A method for processing wastewater in a building, the method comprising:

providing a wastewater disposal system in the building, the wastewater disposal system comprising a tank having an inlet port and a grinder pump disposed in the tank, the grinder pump having a grinder and a pump;

connecting the inlet port to a wastewater feed pipe in the building;

connecting the grinder pump to a wastewater discharge pipe in the building; and connecting the grinder pump to a standard electrical outlet in the building.

16. A method of claim 15 wherein the wastewater disposal system further comprises an alarm unit for indicating a problem with operation of the wastewater disposal system.

* * * * *